US005239953A

United States Patent [19]

Shida

[11] Patent Number: 5,239,953

[45] Date of Patent: Aug. 31, 1993

[54] HYDRAULIC TAPPET FOR AN INTERNAL COMBUSTION ENGINE

[75] Inventor: Toshimitsu Shida, Fujisawa, Japan

[73] Assignee: Fuji Oozx Inc., Japan

[21] Appl. No.: 3,025

[22] Filed: Jan. 11, 1993

[30] Foreign Application Priority Data

Mar. 3, 1992 [JP] Japan ..... 4-080263

[51] Int. Cl.[5] ..... F01L 1/24

[52] U.S. Cl. ..... 123/90.55; 123/90.51

[58] Field of Search ..... 123/90.48, 90.49, 90.51, 123/90.52, 90.55; 74/569

[56] References Cited

U.S. PATENT DOCUMENTS

| | | | |
|---|---|---|---|
| 4,590,898 | 5/1986 | Buente et al. | 123/90.55 |
| 4,656,978 | 4/1987 | Deuring | 123/90.55 |
| 4,694,790 | 9/1987 | Kowal | 123/90.55 |
| 4,924,825 | 5/1990 | Speil | 123/90.55 |
| 5,119,774 | 6/1992 | Krieg et al. | 123/90.55 |
| 5,129,372 | 7/1992 | Seiberth et al. | 123/90.55 |

FOREIGN PATENT DOCUMENTS

| | | | |
|---|---|---|---|
| 3721677 | 1/1989 | Fed. Rep. of Germany | 123/90.55 |
| 3023686 | 1/1982 | Japan | 123/90.55 |
| 49910 | 2/1990 | Japan | 123/90.55 |
| 8605238 | 9/1986 | PCT Int'l Appl. | 123/90.55 |

*Primary Examiner*—E. Rollins Cross
*Assistant Examiner*—Weilun Lo
*Attorney, Agent, or Firm*—Poms, Smith, Lande & Rose

[57] ABSTRACT

A hydraulic tappet comprises a body which comprises an outer tube, an inner tube and an upper portion which connects the two tubes at the upper end. Within the inner tube, there are provided inner and outer plungers. The outer plunger abuts a valve stem of an engine valve in a DOHC-type engine. The outer plunger is supported by a reinforcement member directly or via the inner plunger to provide high rigidity.

12 Claims, 2 Drawing Sheets

HYDRAULIC TAPPET FOR AN INTERNAL COMBUSTION ENGINE

BACKGROUND OF THE INVENTION

The present invention relates to a hydraulic tappet which is installed in a direct acting valve movement mechanism in an internal combustion engine, thereby avoiding a valve clearance automatically in a valve-movement system.

Recently a hydraulic tappet has been provided in a direct-acting valve movement mechanism such as a DOHC-type engine.

A valve clearance is formed with heating during engine driving or with wear of parts in the valve-movement mechanism. A hydraulic tappet makes the valve clearance to zero, thereby decreasing mechanical noise in the valve-movement system. This type of a known hydraulic tappet is disclosed, for example, in Japanese Patent Laid-Open Pub. No. 1-20286. The hydraulic tappet comprises a cylindrical inner casing for guiding a plunger therein, the inner casing being integrally formed with a web which extends in a radial direction inwardly of an outer casing which has a receiving plate which abuts a rotary cam, the receiving plate being fixed on the upper surface of the outer casing.

To increase allowable rotation speed, parts which act in the valve-movement system are made as light as possible, thereby reducing effects involved by inertia force and increasing followability of the valve to a cam. In particular, a hydraulic tappet includes a valve clearance adjusting mechanism to increase the whole weight, which is less advantageous than a normal tappet. It is required to decrease weight thereof. Also, since the hydraulic tappet vigorously moves up and down, high rigidity is greatly required.

In the known hydraulic tappet in which the plunger-containing inner casing is supported only by the web in the outer casing, not only the inner casing but also web or outer casing needs thick-walls and high rigidity. Further the receiving plate which is subject to large load by the cam is fixed on the outer casing. Therefore, to attain high bonding strength by increasing bonding area, the outer casing must be made to have large thickness. If each part has thick walls, the whole weight of the tapped is increased, so that it is impossible to increase allowable rotation speed of an engine.

An object of the present invention is to overcome the foregoing disadvantages and to provide a hydraulic tappet for an internal combustion engine in which the tappet itself is decreased in weight without reducing strength or rigidity, thereby increasing allowable rotation speed.

SUMMARY OF THE INVENTION

According to the present invention, there is provided a hydraulic tappet for an internal combustion engine, comprising an inner tube; an outer tube which slidably abuts a cylinder head which surrounds it; an upper portion which connects the inner and outer tubes at an upper end to constitute a body which can be integrally moulded; a cover plate fixed on the upper portion so that a rotary cam may slidably move on the cover plate; an outer plunger movable up and down within the inner tube, a lower end of the outer plunger abutting an upper end of a stem of an engine valve; an inner plunger movable within the outer plunger, the inner plunger communicating with the outer plunger through an opening at its center so that oil may pass through the opening; and a reinforcement member provided between the outer plunger and the outer tube for supporting the outer plunger.

The inner tube for guiding the outer plunger is integrally molded with the outer tube and the upper portion, for example, by stamping a thin-walled steel plate; the inner and outer tubes are connected with each other by radially outwardly inclined reinforcement member, and by fixing the cover plate on the upper portion over a large width, high rigidity against radially and/or axially acting load is attained. Even if the body has thin walls as a whole, desired strength could be attained.

There are advantages in this invention as below:

a) The body which includes the inner tube is strengthened, thereby allowing the body itself to be thin-walled and decreasing weight of the hydraulic tappet.

b) As a result, inertia force is decreased during valve operation, thereby increasing allowable rotation speed and providing the highest output.

c) The thin-walled body facilitates moulding, for example, by stamping, and decreases cost compared with conventional moulding.

BRIEF DESCRIPTION OF THE DRAWINGS

The structure and advantages of the present invention will become more clear with the following description with respect to embodiments which are illustrated in appended drawings as below.

PREFERRED EMBODIMENTS OF THE INVENTION

Figure 1:
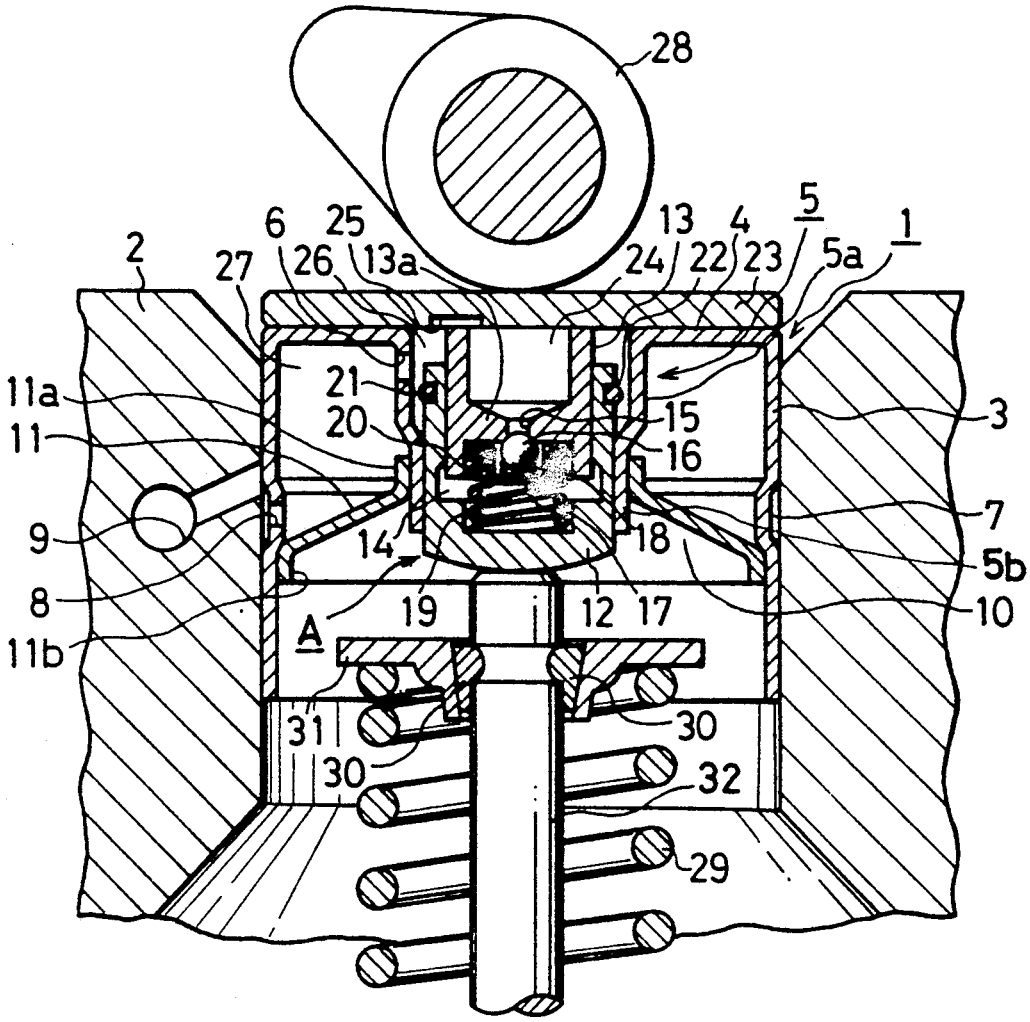
FIG. 1 is a central longitudinally sectioned front view of a first embodiment of the present invention.

FIG. 1 illustrates a first embodiment of a hydraulic tappet according to the present invention. The numeral 1 denotes a thin-walled cylindrical body which comprises an outer tube 3 which slidably abuts a cylinder head 2; an annular upper portion 4 at the upper end of the outer tube 3; and a short tube 5 downwardly extending from the inner end of the upper portion 4. The body 1 may be easily molded, for example, by deep drawing of a thin walled steel plate with a press.

The inner tube 5 is substantially a half as long as the outer tube 3. There are a larger diameter portion 5*a* from the middle to the upper end in the inner tube, and a smaller diameter portion 5*b* therebelow. A number of oil bores 6 are provided on the circumferential wall of the larger diameter portion 5*a*.

There is provided a circumferential groove 7 at the middle of the outer tube 3. An oil bore 8 is formed at the circumferential groove 7 and communicates with an oil path 9 of the cylinder head 2. An annular chamber 10 between the inner and outer tubes 1 and 5 is divided by a radially-inclined annular reinforcement member 11. Explaining it in detail, an upward flange 11*a* of the reinforcement member 11 is fixed to a lower outer portion of the inner tube 5, and a downward flange 11*b* of the reinforcement member 11 is fixed to the inner circumference of the outer tube 3 below a circumferential groove 7. The reinforcement member 11 is connected to the inner and outer tubes 5 and 3 by welding, brazing, bonding, etc.

Within the smaller diameter portion 5*b* of the inner tube 5, there is slidably provided an outer plunger 12 in which a bottom-having inner plunger 13 is slidably provided. Between the inner and outer plungers 12 and 13, there is formed a high-pressure oil chamber 14.

At the center of a bottom wall 13*a* of the inner plunger 12, there is provided an opening 15 which communicates with the high-pressure oil chamber 14 comprising a check ball 16 which engages with the lower end of the opening 15 to open and close it; a bottom-having cylindrical retainer 17 which has an upper outward flange which abuts a lower surface of the bottom wall 13*a*; a check valve mechanism which comprises a compression spring 18 between the check ball 16 and the retainer 17; and a return spring (compression spring) 19 between the outer plunger 12 and the retainer 17.

The check valve mechanism and the return valve 19 constitute a valve clearance adjusting unit "A". The outer and inner plungers 12 and 13 are biased to go away form each other. A plurality of oil bores 20 are provided through a circumferential wall of the retainer 17. The outer plunger 12 has a circumferential groove 21 in which a snap ring 22 fits, thereby preventing the outer plunger 12 from disengaging through the smaller-diameter portion 5*b* of the inner tube 5.

On the upper portion 4 of the body 1, a circular cover plate 23 which has substantially the same diameter as the outer tube 3 is fixed by connecting means such as welding, brazing, liquid phase baking and bonding. The circular cover plate 23 is made of steel or iron which is hardened by cementation, nitriding, tempering, etc. or of surface treatment wear resistant titanium, aluminum alloys, fine ceramics, etc. Upper movement of the inner plunger 13 is prevented by the cover plate 23. There is formed a low-pressure oil chamber 24 within the inner plunger 13 when the upper end of the inner plunger 13 abuts the lower surface of the cover plate 23. An oil recess 25 is provided at a contact surface of the cover plate 23. An oil feed chamber 26 between the inner tube 5 and the outer and inner plungers 12 and 13 communicates with the low-pressure oil chamber 24 via the oil recess 25.

The oil feed chamber 26 communicates with an oil storage chamber 27 between the inner and outer tubes 5 and 3 via the oil bore 6 of the inner tube 5. The oil storage chamber 27 communicates with the oil path 9 of the cylinder head 2 via the oil bore 8 of the outer tube 3, and engine oil which circulates through the oil path 9 is fed into the oil storage chamber 27, the oil feed chamber 26 and the low-pressure oil chamber 24.

A rotary cam 28 abuts the upper surface of the closing cover plate 23. The upper end of a valve stem 32 of an engine abuts a lower surface of the outer plunger 12. The valve stem 32 is connected to a receiving plate 31 which is supported by a pair of cotters 30 and 39, the receiving plate 31 being biased upwardly by a valve spring 29.

The operation of the foregoing embodiments will be described as below.

When the valve stem 32 is lowered to open the engine valve by lowering the body 1 itself with rotation of the rotary cam 28, the inner plunger 13 is lowered within the outer plunger 12 against the return spring 19. Thus, the pressure in the high-pressure oil chamber 14 is higher than that in the low-pressure oil chamber 24 and the check ball 16 closes the opening 15, thereby increasing oil pressure in the high-pressure oil chamber 14. Therefore, the oil in the high-pressure oil chamber 14 acts as rigid body, thereby preventing relative movement of the outer plunger 12 to the inner plunger 13. So, the valve stem 32 goes down against the valve spring 29, thereby opening the engine valve.

During opening of the engine valve, high pressure is kept within the high-pressure oil chamber 14, and the oil in the high-pressure oil chamber 14 partially leaks to the oil feed chamber 26 little by little through a small space between the outer and inner plungers 12 and 13. Thus, the oil in the high-pressure oil chamber 14 decreases at a small extent, and the outer plunger 12 goes up at a very small extent with respect to the inner tube 5 and the inner plunger 13.

The engine valve is closed with further rotation of the rotary cam 28 via the valve stem 32, whereby the force of the valve spring 29 does not act against the outer plunger 12. The outer plunger 12 goes down with respect to the inner tube 5 and the inner plunger 13 and extends by appearance by the range of upward movement or of clearance between the upper end of the valve stem 32 and the lower end of the outer plunger 12. At the same time, the check ball 16 opens the opening 15 and oil which has the same amount as leaked oil is supplied from the low-pressure oil chamber 24 to the high-pressure oil chamber 14.

Owing to the above leakage and supply, the clearance between the rotary cam 28 and the cover plate 23 or between the outer plunger 12 and the upper end of the valve stem 32 is always kept nil, and variation in valve clearance appeared by mechanical action and heating in the valve-movement system can be automatically corrected.

As described above with respect to the first embodiment of the hydraulic tappet, the inner tube 5 for guiding the outer plunger 12 which directly abuts the valve stem 31 and is subject to strong reaction force is molded integrally with the outer tube 3 and the upper portion 4 by using a thin walled steel plate, and the outer circumferential surface of the inner tube 5 is connected with the inner circumferential surface of the outer tube 3 by the radially-inclined reinforcement member 11, thereby exhibiting high rigidity against radial and/or axial load in spite of the thin-walled body 1. Furthermore, the bonding area between the cover plate 23 and the upper portion 4 of the body 1 is large, thereby providing high bonding strength.

Figure 2:
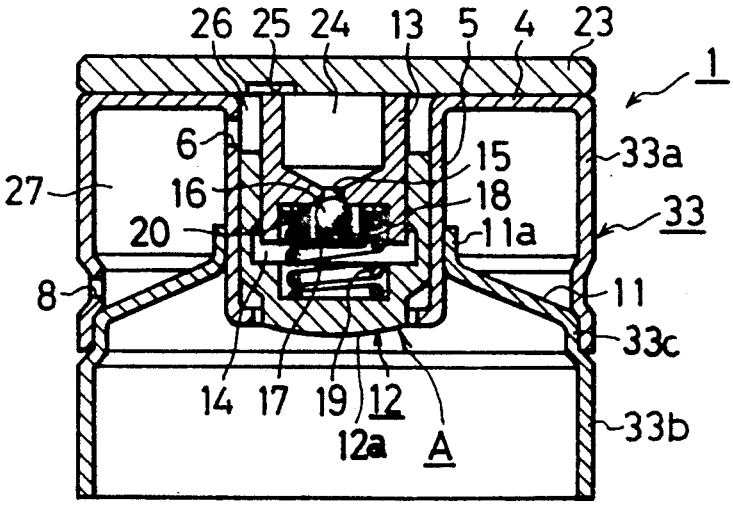
FIG. 2 is a central longitudinally sectioned front view of a second embodiment of the present invention.

A second embodiment of the present invention will be described with respect to FIG. 2.

The same numerals are allotted to the same elements as those in FIG. 1, and detailed descriptions therefor are omitted.

An outer tube 33 in a body 1 of the second embodiment comprises upper and lower tubes 33*a* and 33*b* having the same diameter. With the inner lower end of the upper tube 33*a* is engaged and fixed a smaller diameter portion 33*c* at the upper end of the lower tube 33*b*. The upper portion 4 and the inner tube 5 are integrally connected with the upper tube 33*a* similar to the above embodiment. A reinforcement member 11 is provided at the upper end of the small-diameter portion of the lower tube 33*b*, and an upward flange 11 at the inner end is fixed to a lower outer surface of the inner tube 5.

The lower end of the outer plunger 12 forms a small-diameter stopper 12*a* which prevents the outer plunger 12 from disengaging downwardly by bending a lower opening end of the inner tube 5 inwardly of the stopper 12*a* after the outer plunger 12 is engaged in the inner tube 5. In the second embodiment, there are advantages similar to the first embodiment, and further the upper and lower tubes 33*a* and 33*b* are short, thereby facilitating deep draw moulding thereof. Also, the reinforcement member 11 is integrally formed with the lower tube 33*b*, thereby facilitating assembling.

Figure 3:
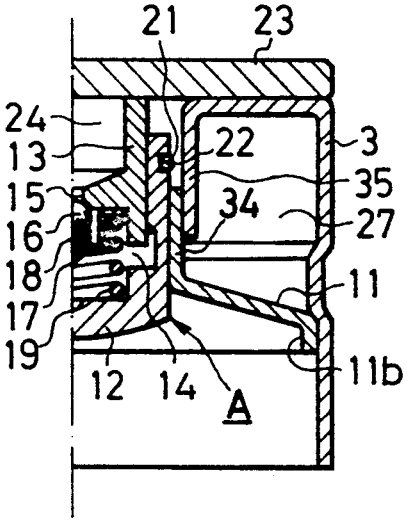
FIG. 3 is a sectional view of a third embodiment of the present invention.

FIG. 3 illustrates a third embodiment of the present invention. The third embodiment is a variation of the first embodiment. In the embodiment, an upward flange 34 at the inner end of a reinforcement member 11 is long, thereby providing a large guiding area for an outer plunger 12, and an inner tube 35 which extends downwardly from an outer tube 3 is fixed to the outer circumference of the flange 34.

Figure 4:
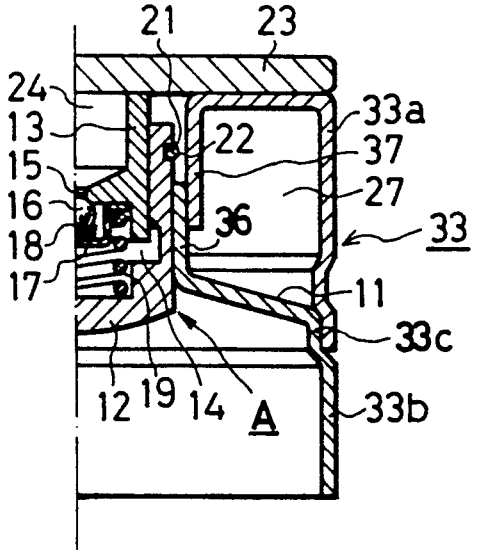
FIG. 4 is a sectional view of a fourth embodiment of the present invention.

FIG. 4 illustrates a fourth embodiment of the present invention. The fourth embodiment is a variation of the second embodiment. In the embodiment, an upward flange 36 of a reinforcement member 11 integrally formed with a lower tube 33*b* is long, thereby increasing a guide surface of an outer plunger 12, an inner tube 37 which extends downwardly from an upper tube 33*a* being fixed to the outer circumferential surface. A snap ring 22 is provided in a circumferential groove 21 of the outer surface of the outer plunger 12, thereby preventing disengagement of the outer plunger 12.

The foregoing merely relates to preferred embodiments of the present invention. Any modifications and variations may be carried out by person skilled in the art without departing from the scope of appended claims as below:

What is claimed is:

1. A hydraulic tappet for an internal combustion engine, comprising:

an inner tube;

an outer tube which slidably abuts a cylinder head which surrounds it;

an upper portion which connects the inner and outer tubes at an upper end to constitute a body which can be integrally moulded;

a cover plate fixed on the upper portion so that a rotary cam may slidably move on the cover plate;

an outer plunger movable up and down within the inner tube, a lower end of the outer plunger abutting an upper end of a stem of an engine valve;

an inner plunger movable within the outer plunger, the inner plunger communicating with the outer plunger through an opening at its center so that oil may pass through the opening; and a separate reinforcement member provided between the outer plunger and the outer tube for supporting the outer plunger.

2. A hydraulic tappet as defined in claim 1 wherein the reinforcement member is inclined downwardly in a radially outward direction.

3. A hydraulic tappet as defined in claim 1 wherein at the opening of the inner plunger there are provided a check valve, a retainer therefor and a compression spring between the check valve and the retainer so that oil may flow only in one direction from the inner plunger to the outer plunger.

4. A hydraulic tappet as defined in claim 3 wherein the check valve comprises a check ball.

5. A hydraulic tappet as defined in claim 1 wherein there is provided a snap ring in a circumferential groove of the outer plunger so as to prevent the outer plunger from disengaging downwardly.

6. A hydraulic tappet as defined in claim 3 wherein a return spring is provided between the outer plunger and the retainer.

7. A hydraulic tappet as defined in claim 1 wherein the outer plunger is surrounded by the inner tube which is supported by an upward flange of the reinforcement member thereon.

8. A hydraulic tappet as defined in claim 7 wherein the reinforcement member is integrally formed with a lower tube which is engaged with a lower end of the outer tube.

9. A hydraulic tappet as defined in claim 1 wherein the outer plunger is directly supported by an upward flange of the reinforcement member.

10. A hydraulic tappet as defined in claim 9 wherein the reinforcement member is formed integrally with a lower tube which is engaged with a lower end of the outer tube.

11. A hydraulic tappet as defined in claim 1 wherein the outer and inner tubes and the upper portion are integrally moulded by deep drawing of a thin-walled steel plate.

12. A hydraulic tappet as defined in claim 1 wherein the cover plate is moulded out of wear-resistant material.

* * * * *